US007097510B1

(12) United States Patent
Chen

(10) Patent No.: US 7,097,510 B1
(45) Date of Patent: Aug. 29, 2006

(54) MEMORY CARD ADAPTOR DEVICE

(75) Inventor: Chien-Yuan Chen, 5F-1, No. 8 Sec. 3, Shuangsh Rd., Banchiau City, Taipei (TW) 220

(73) Assignees: Power Digital Card Co., Ltd., Taipei (TW); Chien-Yuan Chen, Taipei (TW)

( * ) Notice: Subject to any disclaimer, the term of this patent is extended or adjusted under 35 U.S.C. 154(b) by 0 days.

(21) Appl. No.: 11/140,941

(22) Filed: Jun. 1, 2005

(51) Int. Cl.
*H01R 23/70* (2006.01)

(52) U.S. Cl. ..... 439/630; 439/637

(58) Field of Classification Search ..... 439/59, 439/630, 637, 635, 636, 629
See application file for complete search history.

(56) References Cited

U.S. PATENT DOCUMENTS 5,667,408 A * 9/1997 Broschard et al. ..... 439/630
6,129,588 A * 10/2000 Chang ..... 439/630
6,431,898 B1 * 8/2002 Asakawa ..... 439/325
6,790,061 B1 * 9/2004 Lai et al. ..... 439/159
2003/0060085 A1 * 3/2003 Reece ..... 439/630
2005/0037667 A1 * 2/2005 Yu ..... 439/630
2005/0181674 A1 * 8/2005 Kitamura ..... 439/630

* cited by examiner

*Primary Examiner*—Hien Vu
(74) *Attorney, Agent, or Firm*—Troxell Law Office, PLLC

(57) ABSTRACT

A memory card adaptor includes a cartridge of a same size as a memory card. A slot of a profile equivalent to a size of a mini memory card is formed at one end inside the cartridge, whereas conduction terminals are pre-embedded at the other end thereof. Contact sections are extended toward an interior of the slot from the conduction terminals, for providing a linking of electric signals upon inserting the mini SD card therein. Lead slopes are formed in the slot and are protruded toward an interior from an exterior of the slot, so as to insert the mini SD card in a slant angle, thereby preventing malfunction caused by the mini SD card from being directly pushed against the contact sections in a front of the conduction terminals in the slot, providing a sufficient flexible offsetting to the contact sections.

1 Claim, 4 Drawing Sheets

MEMORY CARD ADAPTOR DEVICE

BACKGROUND OF THE INVENTION (a) Field of the Invention

The present invention relates to an improved device for a memory card adaptor, and more particularly to a memory adapter for accessing data.

(b) Description of the Prior Art

Memory cards are used as a storage media for peripheral digital products. As there are so many kinds of models and brands of digital products in the existing market, the memory cards used will also be different (e.g., a Smart Media Card, a Secure Digital Card, a Multi Media Card, a Memory Stick Card, a CF card, and an XD Card, etc.).

As the prosperity of all kinds of memory cards, all kinds of electronic products and digital equipment are becoming light-weight, thin, short, and tiny. Therefore, associated circuit elements and storage devices are also becoming mini, such as a mini SD card and an MS duo card, whose sizes are only less than a half of a Secure Digital Card (or SD card in short) and a Memory Stick Card (or MS card in short). Accordingly, the corresponding connectors also required to be light-weight and tiny. Therefore, memory cards with a larger size (e.g., a Smart Media Card) are gradually not suitable for the market. However, for re-using a memory card with a smaller size and thickness in an original circuit layout and a connector of an original size, the suitability between the memory card and the connector is imperative. Accordingly, the following positive benefits can be reached providing the availability of a suitable and practical connector:

It can save a process of assembling and can also reduce a manufacturing cost.

It can reduce a space to be occupied, therefore facilitating a compact design for electronic products.

Accordingly, vendors have re-modeled a connector with a specification of size of an SD card into a connector which can be connected with a mini SD card and can be used for an SD memory card. This structure consists of a slot 300 at one end of a cartridge 100 for inserting a mini SD card, and terminals 200 at the other end of the cartridge 100 for conducting a circuit. Through holes 1001 (as shown in FIG. 5) are located at locations corresponding to those of contact sections 2001 of the conduction terminals 200 in the cartridge 300, thereby providing an extended space to the contact sections 2001 of the conduction terminals 200 upon inserting and using the mini SD card. Although this kind of structure can achieve a basic function of adapting a memory card, it is inevitable that alien objects or dust will intrude due to the through holes located at a side of the cartridge 300. In addition, as the slant and raised contact sections 2001 in a front of the conduction terminals 200 are directly and reversely touched and pressed by the corresponding mini SD card upon inserting the card, it is possible to cause deformations to the contact sections 2001, thereby severely affecting the accuracy, stability and quality in inserting and connecting a memory card.

Accordingly, other vendors have put the contact sections 2001 in a front of the conduction terminals 200 to be against inner walls of the cartridge 200, as shown in FIG. 6, with only small parts of the contact sections 2001 being protruded. Although this structure can avoid damage to the conduction terminals 200, an ill contact will occur.

SUMMARY OF THE INVENTION

The primary object of the present invention is to provide an improved adaptor device for a memory card such that a mini SD card is inserted in a slant angle, so as to prevent the mini SD card from being directly pushed against the conduction terminals.

Another object of the present invention is to provide an improved adaptor device for a memory card wherein contact sections for linking electric signals between conduction terminals and the mini SD card are in a raised and slant shape, thereby providing a sufficient flexible offsetting and increasing a moving gap to the contact sections.

Accordingly, the present invention consists of lead slopes in the cartridge. The lead slopes are gradually raised up from an exterior toward an interior of the slot, so as to enable the tail ends of the contact terminals to be higher than the lead slopes. By the aforementioned structure, it can effectively prevent the mini SD card from being directly pushed against the conduction terminals, and allow the conduction terminals to be accurately in contact with the memory card, without affecting a half-seal structure of the slot and a status of flexible offsetting.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
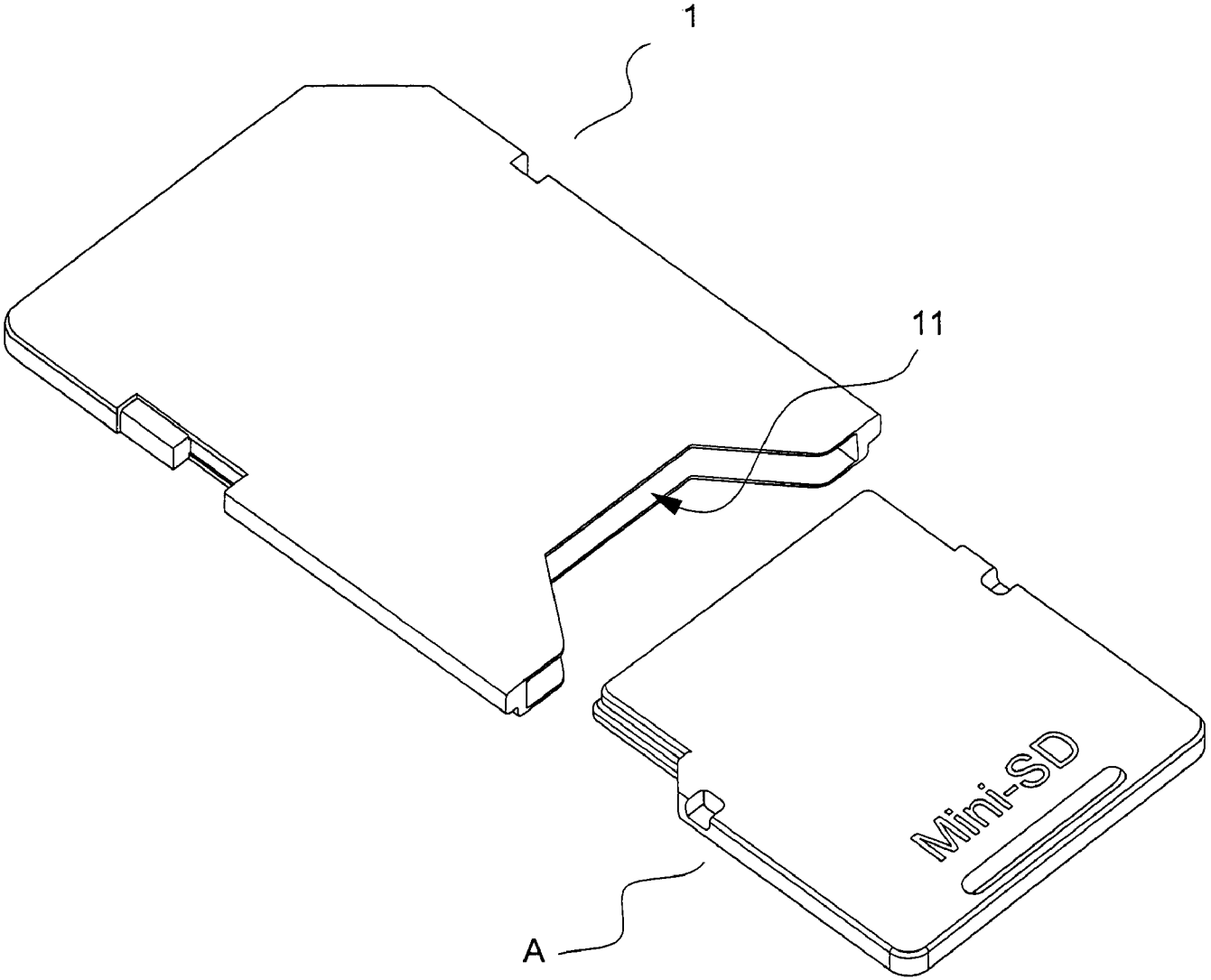
FIG. 1 shows a schematic view of an implementation of the present invention.
Figure 2:
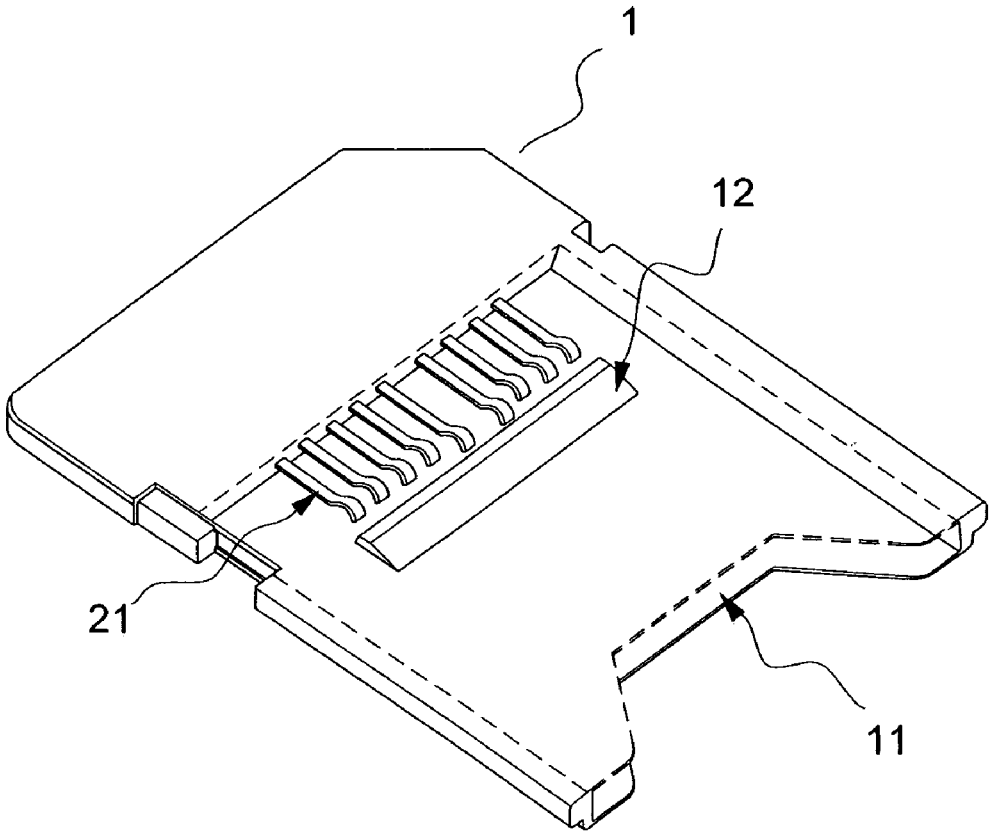
FIG. 2 shows a schematic view of a cartridge structure of an implementation of the present invention.
Figure 3:
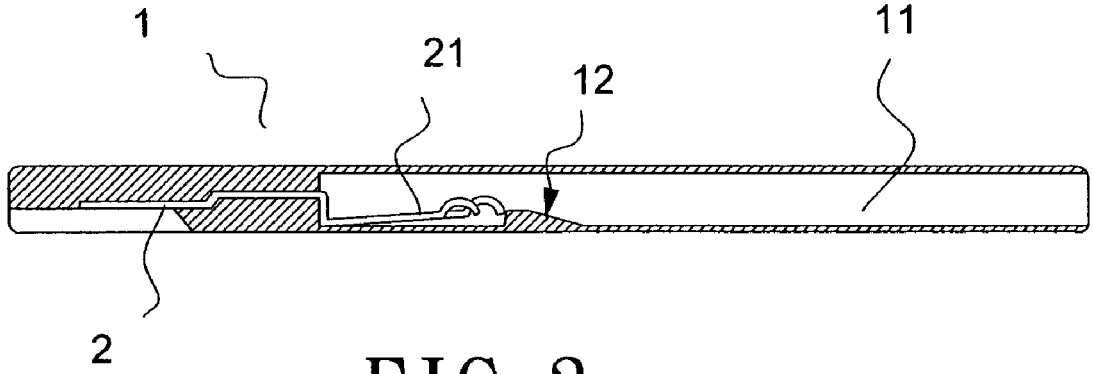
FIG. 3 shows a schematic view of a cross section of FIG. 2.

Referring to FIG. 1 and other drawings, the present invention comprises primarily a cartridge 1 for a same specification of size as an SD card, wherein a slot 11 (as shown in FIG. 2) with a profile equivalent to a specification of size of a mini SD card (A) is formed by extending an inner space of the cartridge 1 toward the other end in a horizontal direction, conduction terminals 2 are pre-embedded in the other end of the cartridge 1, contact sections 21 (as shown in FIG. 3) are extended from the conduction terminals 2 toward an interior of the cartridge 1 and are gradually raised up toward an exterior of an opening of the slot 11 from inner walls of the slot 11, and portions of the contact sections 21 close to a tall end thereof are protruded and bended down at the tail end.

The primary characteristics of the present invention lies in that lead slopes 12 are located in a front of the contact sections 21 close to the conduction terminals 2 in the cartridge 1. The lead slopes 12 are gradually protruding upwardly toward an interior of the cartridge 1, when moving from an exterior of the slot 11 toward the conduction terminals 2 and are installed between the contact sections 21 an open end of the cartridge 1, so as to enable a portion of the tail ends of the contact section to be higher than a top of the lead slopes 12.

By the installation of lead slopes 12, the mini SD card (A) can be inserted in a slant angle upon inserting and connecting the card, such that the mini SD card (A) can be prevented from being directly pushed against the contact sections 21 of the conduction terminals 2, and a sufficient flexible offsetting can be available to the contact sections 21 of the conduction terminals 2, for increasing a moving gap in the slot 11 to the contact sections 21, so as to allow the contact sections 12 to be accurately in contact with the mini SD card, thereby reducing a permanent deformation of the contact sections 12 due to a long term pressing by the memory card, and effectively avoiding a problem of accumulated deformation, without destructing the structure of slot 11.

Figure 4:
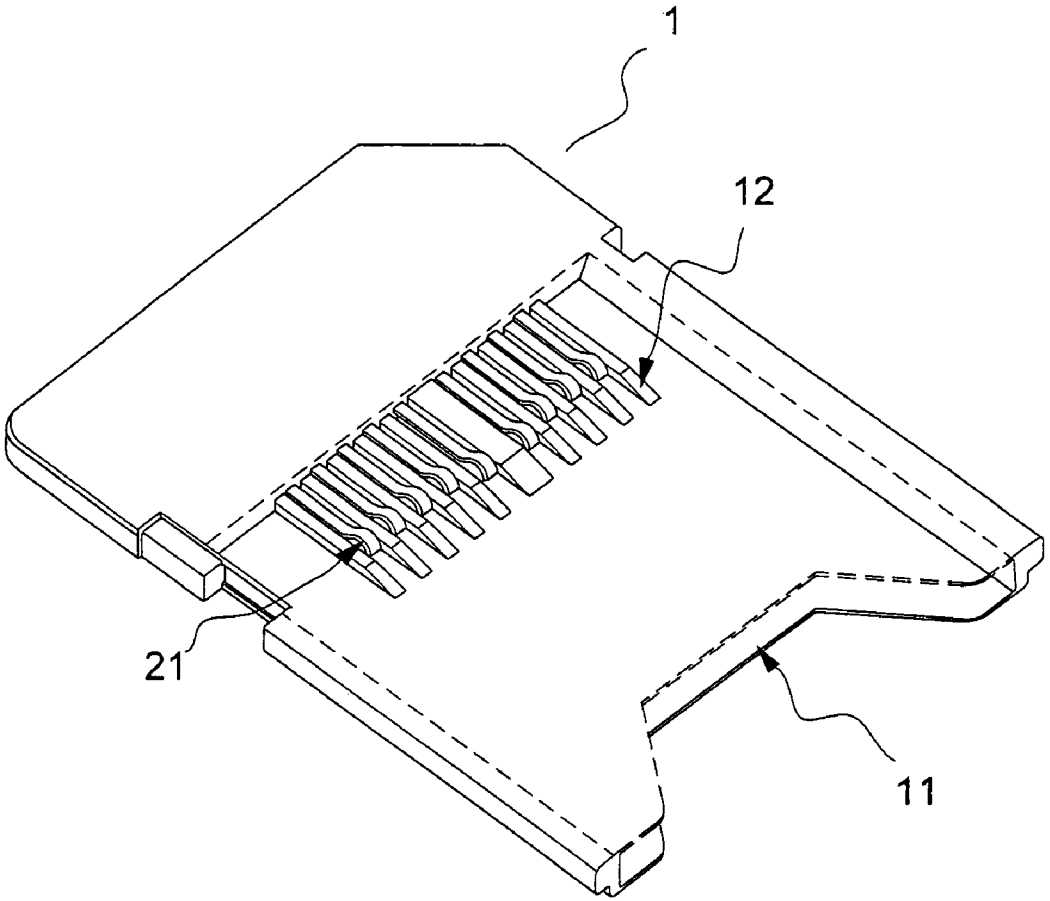
FIG. 4 shows a schematic view of a cartridge structure of another implementation of the present invention.
Figure 5:
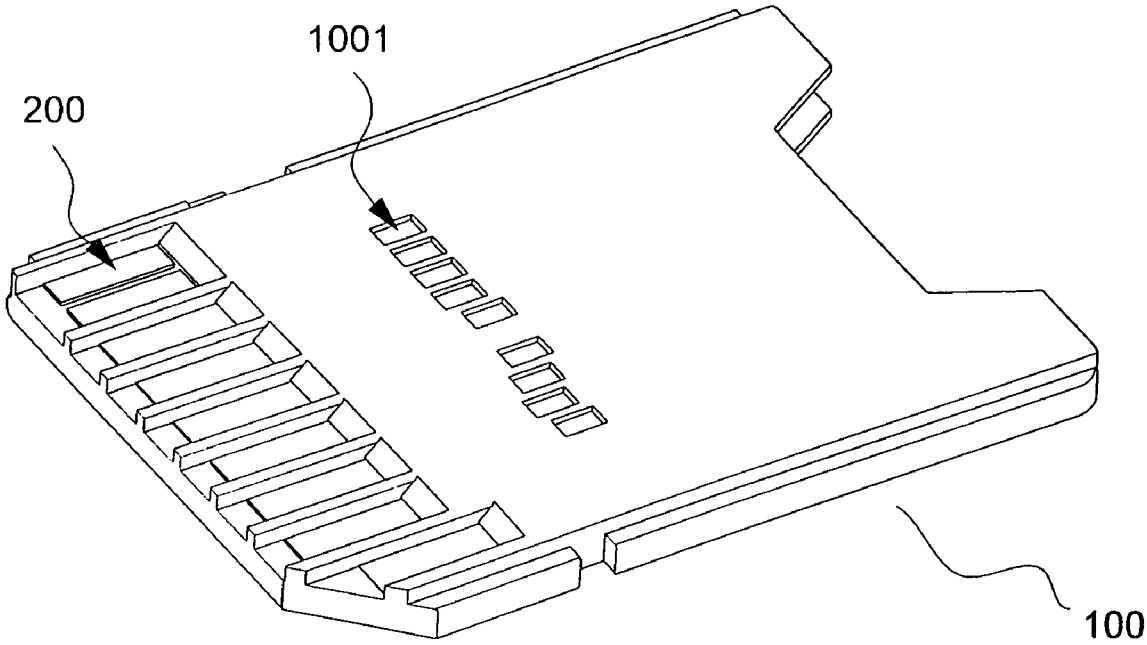
FIG. 5 Prior Art
FIG. 5 shows a schematic view of a structure of a conventional memory card adaptor.
Figure 6:
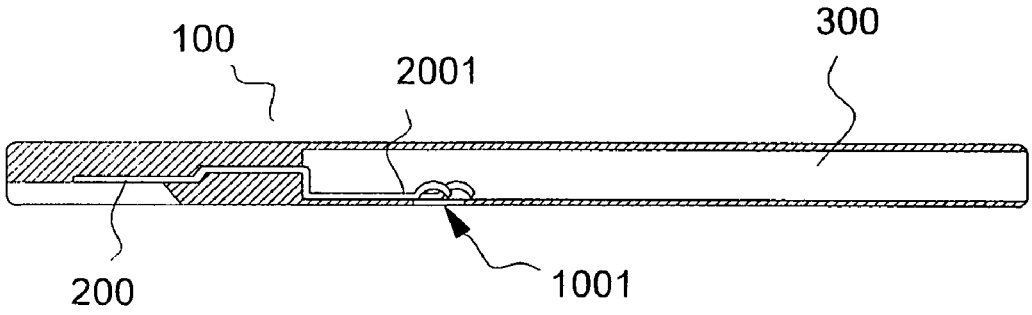
FIG. 6 Prior Art
FIG. 6 shows a cross sectional view of a structure of a conventional memory card adaptor.

Referring to FIG. 4, it shows a schematic view of cartridge structure of another implementation of the present invention. Lead slopes 12 are extended toward conduction terminals 2 and are in alternation with the contact sections 21.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A device for a memory card adaptor for a mini memory card comprising:

a) a cartridge having:
  i) a closed end;
  ii) an open end located opposite the closed end and communicating with a hollow interior thereof, the mini memory card being selectively inserted into and removed from the hollow interior of the cartridge through the open end; and
  iii) at least one lead slope, each of the at least one lead slope has a sloping top surface sloping upwardly from a bottom of the hollow interior toward a top of the hollow interior in a direction moving from the open end toward the closed end, each of the at least one lead slope is spaced apart a predetermined distance from the open end of the cartridge; and b) a plurality of conduction terminals, each of the plurality of conduction terminals having:
  i) a first end extending through a portion of the closed end of the cartridge; and
  ii) a second end extending into the hollow interior toward the at least one lead slope and having a contact section located on an end thereof, the second end is located opposite the first end, each contact section having a portion located closer to the top of the hollow interior of the cartridge than a highest portion of the at least one lead slope wherein the at least one lead slope includes a plurality of lead slopes, the plurality of lead slopes are alternately positioned between the plurality of conduction terminals.

* * * * *